US008672462B2

(12) United States Patent
Nakamura

(10) Patent No.: US 8,672,462 B2
(45) Date of Patent: Mar. 18, 2014

(54) INK SUPPLY DEVICE AND IMAGE RECORDING APPARATUS

(75) Inventor: Hirotake Nakamura, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 18 days.

(21) Appl. No.: 13/034,368

(22) Filed: Feb. 24, 2011

(65) Prior Publication Data

US 2011/0310184 A1 Dec. 22, 2011

(30) Foreign Application Priority Data

Jun. 17, 2010 (JP) ..... 2010-137802

(51) Int. Cl.
*B41J 2/175* (2006.01)
*B41J 2/125* (2006.01)

(52) U.S. Cl.
USPC ..... 347/86; 347/50

(58) Field of Classification Search
USPC ..... 347/85, 86
See application file for complete search history.

(56) References Cited

U.S. PATENT DOCUMENTS

| | | | | |
|---|---|---|---|---|
| 5,138,344 | A | 8/1992 | Ujita | |
| RE36,279 | E | 8/1999 | Ujita | |
| 5,966,155 | A * | 10/1999 | Pawlowski et al. | 347/85 |
| 6,030,074 | A * | 2/2000 | Barinaga | 347/85 |
| 6,074,042 | A | 6/2000 | Gasvoda et al. | |
| 6,422,693 | B2 * | 7/2002 | Pawlowski et al. | 347/85 |
| 6,598,963 | B1 * | 7/2003 | Yamamoto | 347/86 |
| 6,755,500 | B2 * | 6/2004 | Hirano et al. | 347/22 |
| 6,938,996 | B2 * | 9/2005 | Sasaki et al. | 347/85 |
| 7,467,862 | B2 * | 12/2008 | Kawamura et al. | |
| 7,506,944 | B2 * | 3/2009 | Umeda | 347/7 |
| 7,878,666 | B2 * | 2/2011 | Muraki et al. | 353/122 |
| 7,918,548 | B2 * | 4/2011 | Hattori et al. | 347/86 |
| 8,157,344 | B2 * | 4/2012 | Kondo | 347/19 |
| 2002/0070985 | A1 | 6/2002 | Takagi | |
| 2003/0184622 | A1 * | 10/2003 | Sasaki et al. | 347/85 |
| 2003/0184623 | A1 * | 10/2003 | Sasaki et al. | 347/85 |
| 2004/0150697 | A1 * | 8/2004 | Sasaki et al. | 347/85 |
| 2004/0218000 | A1 * | 11/2004 | Farr et al. | 347/19 |
| 2007/0002290 | A1 * | 1/2007 | Muraki et al. | 353/119 |
| 2009/0141095 | A1 * | 6/2009 | Umeda | 347/85 |
| 2009/0195573 | A1 * | 8/2009 | Aoki et al. | 347/7 |
| 2009/0219310 | A1 * | 9/2009 | Kondo | 347/7 |
| 2009/0322836 | A1 * | 12/2009 | Kanbe et al. | 347/86 |
| 2011/0310184 | A1 * | 12/2011 | Nakamura | 347/85 |
| 2011/0310189 | A1 * | 12/2011 | Kanbe et al. | 347/86 |

(Continued)

FOREIGN PATENT DOCUMENTS

| | | |
|---|---|---|
| JP | 3227650 | 10/1991 |
| JP | 11138842 | 5/1999 |

(Continued)

*Primary Examiner* — Matthew Luu
*Assistant Examiner* — Patrick King
(74) *Attorney, Agent, or Firm* — Frommer Lawrence & Haug LLP

(57) ABSTRACT

There is provided an ink supply device including: a cartridge installing section configured to install the ink cartridge in a horizontal direction; an ink supply section configured to be fluid communication with an ink supply portion of the ink cartridge; a first sensor disposed in the ink cartridge installing section and positioned under the ink supply section in a vertical direction; and a first partitioning member partitioned the ink supply section and the sensor in the vertical direction.

15 Claims, 12 Drawing Sheets

(56) References Cited

U.S. PATENT DOCUMENTS

| | | | | |
|---|---|---|---|---|
| 2011/0310190 | A1* | 12/2011 | Kanbe et al. | 347/86 |
| 2011/0310192 | A1* | 12/2011 | Kanbe et al. | 347/86 |
| 2011/0310195 | A1* | 12/2011 | Nakamura | 347/86 |
| 2011/0310199 | A1* | 12/2011 | Kanbe et al. | 347/86 |

FOREIGN PATENT DOCUMENTS

| | | |
|---|---|---|
| JP | 2002/513341 | 5/2002 |
| JP | 2007/015393 | 1/2007 |
| JP | 2009/132098 | 6/2009 |

* cited by examiner

INK SUPPLY DEVICE AND IMAGE RECORDING APPARATUS

CROSS REFERENCE TO RELATED APPLICATION

The present application claims priority from Japanese Patent Application No. 2010-137802, filed on Jun. 17, 2010, the disclosure of which is incorporated herein by reference in its entirety.

BACKGROUND OF THE INVENTION

1. Field of the Invention

The present invention relates generally to an ink supply device in which an ink cartridge is removably installed in a cartridge installing section, and to an image recording apparatus including the ink supply device.

2. Description of the Related Art

Conventionally, in an image recording apparatus of what is called a tube supply type, an ink cartridge is disposed outside a carriage on which a recording head is mounted, and the ink cartridge and the recording head are connected to each other via a tube. In a cartridge installing section having an opening, for example, in a front surface of an apparatus body, this ink cartridge is installed in a horizontal direction via the opening (refer to Japanese Patent Application Laid-open No. 2009-132098). The cartridge installing section houses the ink cartridge in a removable manner. When the ink cartridge is installed in the cartridge installing section, an ink channel ranging from the ink cartridge to the recording head is formed. Ink is supplied to the recording head from the ink cartridge through the ink channel.

In order to allow the ink stored in the ink cartridge to flow out, a hollow needle called an ink needle or the like is provided in the cartridge installing section. Inserting the ink needle to the ink cartridge allows the ink stored in the ink cartridge to flow out through the ink needle.

In the cartridge installing section, there is sometimes provided a sensor for detecting a remaining amount of the ink stored in the ink cartridge (Japanese Patent Application Laid-open No. 2007-15393). Further, a sensor for detecting whether or not the ink cartridge is installed is sometimes provided in the cartridge installing section. Among image recording apparatuses of what is called an on-carriage type in which an ink cartridge is installed on a carriage, there is also known an apparatus in which an optical sensor provided below the carriage detects a remaining amount in an ink cartridge mounted on the carriage moving above the optical sensor.

Disposing the aforesaid various kinds of sensors at or adjacent to the ink needle has an advantage that the ink cartridge is installed in the cartridge installing portion can be accurately detected. However, if the various kinds of sensors, substrates, and so on are disposed near the ink needle and the tube, the ink leaking from the ink needle or the tube adheres to the sensors or the substrates, for example, during the transport of the image recording apparatus from a user to a service center, which might be a cause of a trouble of the sensors and the substrates. Such a problem is likely to occur when the sensors and the substrates are disposed on a lower side of the ink needle and the tube in the vertical direction (gravity direction). Thus, the layout of the sensors and the substrates in the cartridge installing section is restricted by the relation with the arrangement of the ink needle and the tube, and generally, disposing the sensors and the like below the ink needle and the like has been avoided. Incidentally, in the image recording apparatus of the on-carriage type, the sensors are sometimes disposed below the ink cartridge, but since the ink cartridge is not always present above the sensors, there is little risk that the ink leaking from the ink cartridge and the like adheres to the sensors.

SUMMARY OF THE INVENTION

Therefore, a need has arisen for ink supply device and recording apparatus which overcome the above and other shortcomings of the related art. A technical advantage of the present invention is that the configuration of a sensor to be disposed at or adjacent to a connecting section or an ink channel.

Another technical advantage of the present invention is that the configuration of the first partitioning member and the first sensor allow the recording apparatus to be accurately determined the ink cartridge is set in the installed position.

According to a first aspect of the present invention an ink supply device is provided as is defined in claim 1. According to the another aspect of present invention a recording apparatus is provided as is defined in claim 12.

Other objects, features, and advantages of embodiments of the present invention will be apparent to persons of ordinary skill in the art from the following description of preferred embodiments with reference to the accompanying drawings.

DETAILED DESCRIPTION OF THE PREFERRED EMBODIMENTS

Hereinafter, an embodiment of the present teaching will be explained with reference to the drawings when necessary. It should be noted that the embodiment explained below is only an example where the present teaching is embodied, and it goes without saying that the embodiment can be appropriately modified within a scope of the present teaching.

<Outline of Printer 10>

Figure 1:
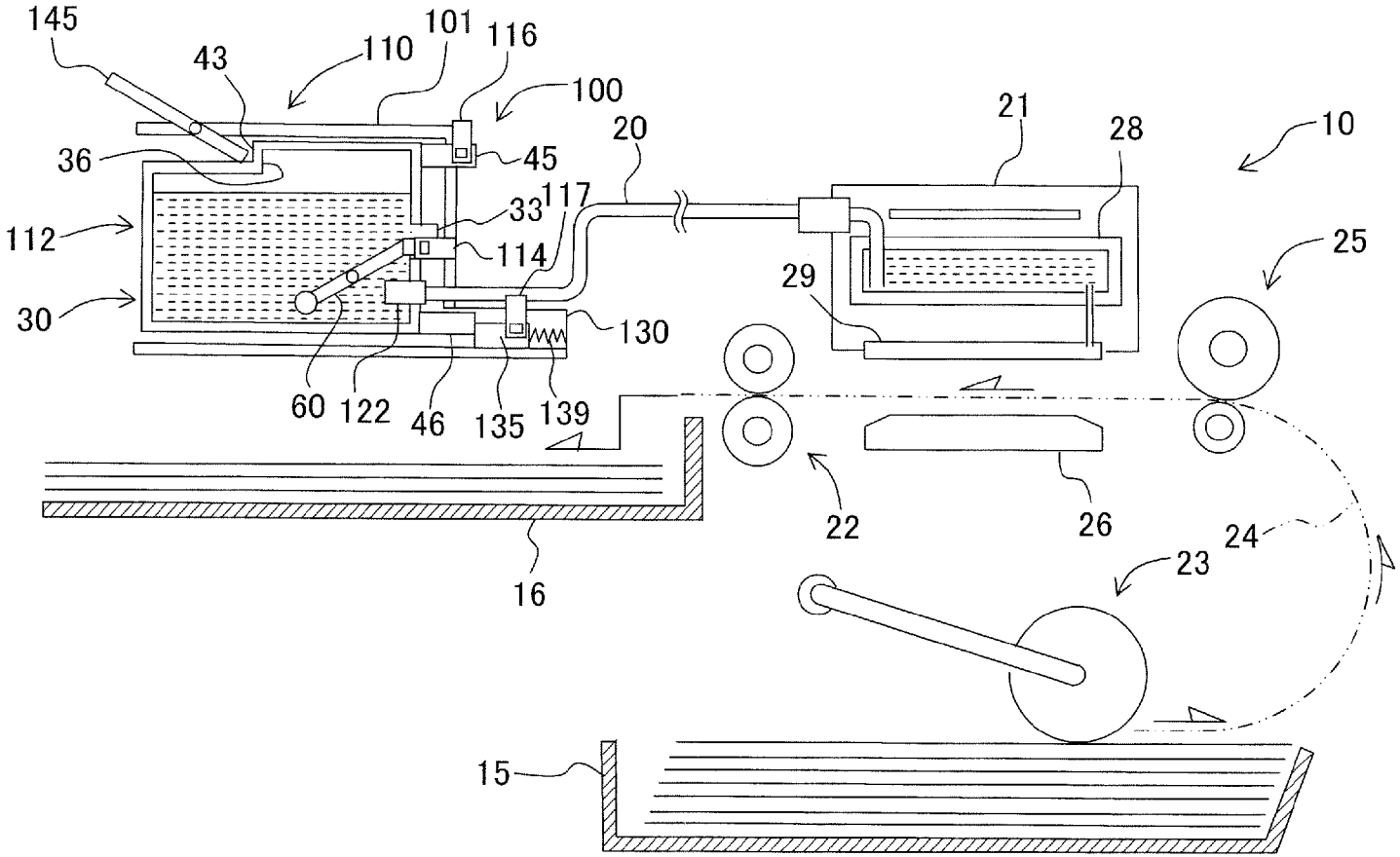
FIG. 1 is a schematic cross-sectional view schematically illustrating an internal structure of a printer 10, including an ink supply device 100, according to an embodiment of the embodiment of the invention.

As shown in FIG. 1, a printer 10 records an image by selectively jetting ink droplets to a recording paper based on an ink-jet recording method. The printer 10 includes an ink supply device 100. In the ink supply device 100, a cartridge installing section 110 is provided. The cartridge installing section 110 is configured so that ink cartridges 30 are installable. In the cartridge installing section 110, an opening 112 at which one surface of the cartridge installing section 110 is opened to the outside is provided. Via the opening 112, the ink cartridges 30 are inserted into or removed from the cartridge installing section 110. The printer 10 corresponds to an image recording apparatus according to the present teaching.

In the ink cartridges 30, the ink usable in the printer 10 is stored. In a state where the ink cartridges 30 are installed in the cartridge installing section 110, the ink cartridges 30 and the recording head 21 are connected to each other by ink tubes 20. Sub-tanks 28 are provided in a recording head 21. The sub-tanks 28 temporarily store the ink supplied through the ink tubes 20. The ink supplied from the sub-tank 28 is jetted selectively from nozzles 29 of the recording head 21. The recording head 21 corresponds to a recording section in the present teaching. Each of the ink tubes 20 corresponds to an ink channel in the present teaching.

The recording paper placed on a paper feeding tray 15 is fed to a transporting route 24 by a paper feeding roller 23. The recording paper fed to the transporting route 24 is transported onto a platen 26 by a transporting roller pair 25. The recording head 21 is disposed to face the platen 26. The recording head 21 selectively jets the ink to the recording paper passing on the platen 26. Consequently, an image is recorded to the recording paper. The recording paper having passed the platen 26 is discharged by a discharge roller pair 22 to a paper discharge tray 16 provided on the most downstream side of the transporting route 24.

<Ink Cartridge 30>

Figure 2:
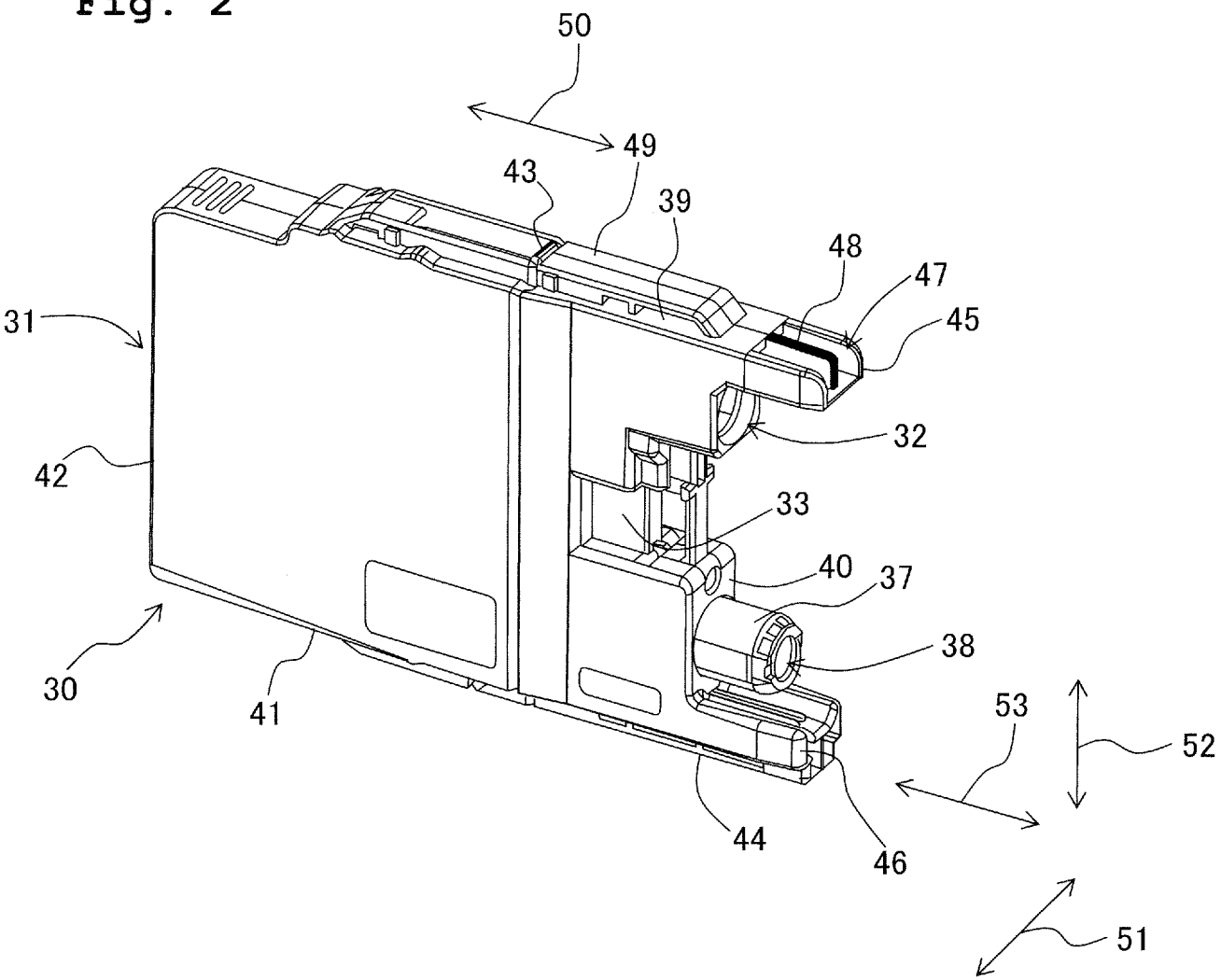
FIG. 2 is a perspective view illustrating an external configuration of an ink cartridge 30.

As shown in FIG. 2, the ink cartridge 30 is a container storing the ink. A space formed inside the ink cartridge 30 is an ink chamber 36 storing the ink (refer to FIG. 8). The ink chamber 36 may be a space formed by a body 31 demarcating an exterior of the ink cartridge 30, or may be a space formed by a member different from the body 31.

The ink cartridge 30 is inserted into the cartridge installing section 110 along an installing direction (insertion direction) 56 and removed from the cartridge installing section 110 along a removal direction 55 that is an opposite direction of the installing direction 56, upon setting in an upright posture shown in FIG. 2, that is, with its lower surface in FIG. 2 set as a bottom surface and with its upper surface in FIG. 2 set as a top surface. That is, the ink cartridge 30 is installed into or removed from the cartridge installing section 110 while kept in the upright posture. A height direction (up-down direction) 52 in FIG. 2 corresponds to a vertical direction.

The ink cartridge 30 has the body 31 in a substantially rectangular parallelepiped shape. The body 31 has a flat shape which is small in a width direction 51 and whose dimensions in the height direction 52 and a depth direction 53 are larger than a dimension in the width direction 51. In the body 31, its wall that becomes a front side and its wall that becomes a rear side when the ink cartridge 30 is installed in the cartridge installing section 110 are a front wall 40 and a rear wall 42 respectively. The front wall 40 and the rear wall 42 face each other in the installing direction 56 (removal direction 55) (longitudinal direction of the ink cartridge 30). Note that the installing direction 56 (removal direction 55) is parallel to the depth direction 53.

On the front wall 40 of the body 31, a translucent portion 33 may project outward from a center of the front wall 40 of body 31 and may extend from the ink chamber. The translucent portion 33 may be integral with the frame 50, and may comprise the same material as the frame 50, e.g., the translucent portion 33 may comprise a translucent resin material to allow light to pass therethrough. An amount of ink stored in the ink chamber may be optically or visually detected through the translucent portion 33. The translucent portion 33 may be partitioned by five rectangular walls and may have a substantially a hollow box shape. The translucent portion 33 may be configured to be sandwiched between a light-emitting element (not shown) and a light-receiving element (not shown) of an optical sensor 114 (refer to FIG. 8), e.g. photo interrupter, mounted to the cartridge installing portion. Light emitted by the light-emitting element may pass through the side walls 33 and may be received by the light-receiving element.

Figure 8:
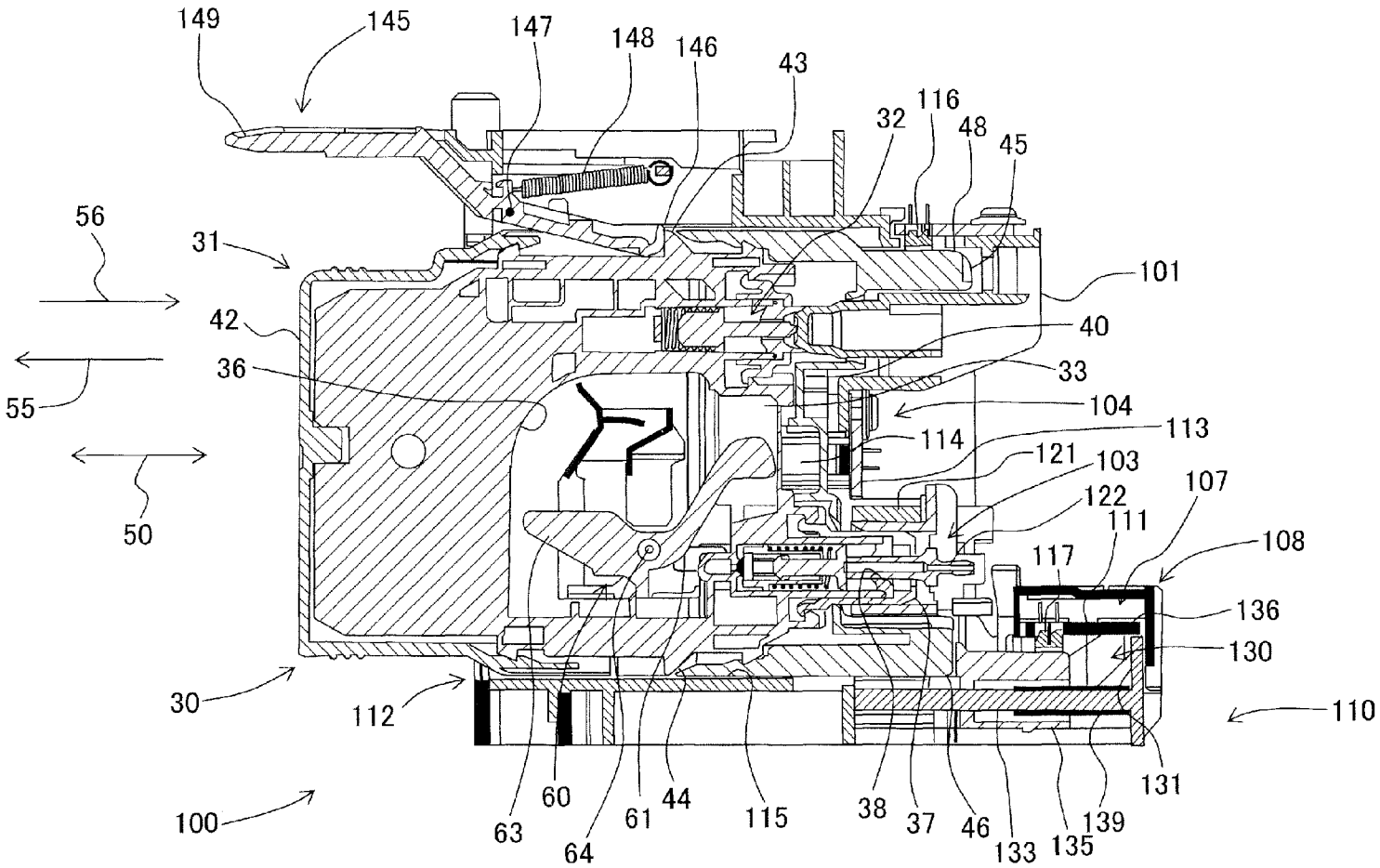
FIG. 8 is a cross-sectional view illustrating a internal configuration where the ink cartridge 30 is installed in the cartridge installing section 110.

As shown in FIG. 8, the pair of side walls of the translucent portion 33 has an inner space formed therebetween and the inner space may be configured to be in fluid communication with the interior of the ink chamber. An indicator portion 62 of a sensor arm 60 is located in the inner space of the translucent portion 83. The sensor arm 60 has the indicator portion 62 and a float portion 63 which are provided at both end sides across a support shaft serving as a pivotal fulcrum of an arm body 61 in a rod shape. The sensor arm 60 is pivotably supported in the ink chamber 36 by a support shaft 64 extending along the width direction 51. The float portion 63 moves upward and downward based on the amount of the ink in the ink chamber 36. Consequently, the sensor arm 60 can change its posture between a lower posture in which the indicator portion 62 is located at a gravity-direction lower side in the translucent portion 33 and an upper posture in which the indicator portion 62 is located at a gravity-direction upper side in the translucent portion 33. Note that FIG. 8 shows a state where the indicator portion 62 takes the lower posture.

In the state where the ink cartridge 30 is installed in the cartridge installing section 110, the translucent portion 33 changes between a state where it transmits infrared light from the optical sensor 114 provided in the cartridge installing section 110 and a state where it shuts off or attenuates the infrared light. Concretely, when the indicator portion 62 takes the upper posture (the amount of the ink is less than a predetermined amount), the translucent portion 33 transmits the light, and when the indicator portion 62 takes the lower posture (the amount of the ink is equal to or more than the predetermined amount), the translucent portion 33 blocks off or attenuates the light. According to this light transmission state of the translucent portion 33, it is determined that a remaining amount of the ink in the ink chamber 36 is less than the predetermined amount.

Figure 9:
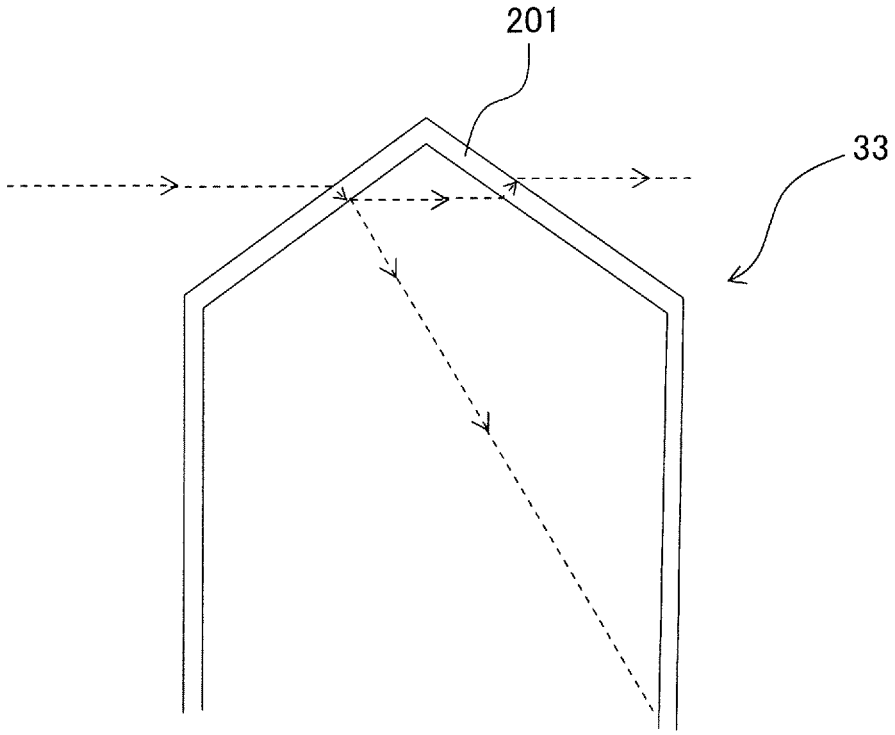
FIG. 9 is a rough view illustrating an example of a translucent portion.

Incidentally, the sensor arm 60 need not be provided in the translucent portion 33. Specifically, the optical sensor 114 has a light-emitting element and a light-receiving element which face each other in a horizontal direction. The light emitted from the light-emitting element is received by the light-receiving element. Under such a structure, the translucent portion 30 may be structured to block or attenuate the light emitted from the light-emitting element while the ink is in the translucent portion 33 and to transmit the light emitted from the light-emitting element while there is no ink in the translucent portion 33. For example, as shown in FIG. 9, a pair of translucent resin walls 201 may be disposed like a roof. In this case, the light entering the resin wall 201 from the air in the horizontal direction in the state where the ink is present is refracted to advance obliquely downward. Here, refractive indexes of the resin walls 201 and the ink approximate to each other, and therefore, when the light enters the ink from the resin wall 201, the light advances straight or is refracted slightly, so that a predetermined light amount is not input to the light-receiving element. On the other hand, when the amount of the ink is less than the predetermined amount, the light entering the resin wall 201 from the air is refracted to advance obliquely downward, and the light further advances in the air in the translucent portion 33 from the resin wall 210. The light entering the air from the resin wall 201 advances in the horizontal direction, and after entering the resin wall 201 again to be refracted and advance obliquely upward, the light enters the air from the resin wall 201 to advance in the horizontal direction and is received by the light-receiving element. Another alternative structure may be such that, when the ink is present in the translucent portion 33, the light emitted from the light-emitting element is reflected so as not to reach the light-receiving element, and when there is no ink in the translucent portion 33, the light emitted from the light-emitting element is reflected so as to reach the light-receiving element.

As shown in FIG. 2, in the front wall 40 of the body 31, an opening passing through the front wall 40 in the depth direction 53 is formed on an upper side of the translucent portion 33, and on a rear wall 42 side of the opening in terms of the depth direction 53, an atmosphere communication port 32 is provided. The atmosphere communication port 32 is a through hole passing through a wall forming the ink chamber 36 in the depth direction 53. An air layer of the ink chamber 36 and the outside can communicate with each other via the atmosphere communication port 32. The atmosphere communication port 32 is configured to be openable/closable by a valve or the like, though a detailed explanation thereof will be omitted. When the atmosphere communication port 32 is opened, the inside of the ink chamber 36 which is in a negative pressure state in a transport condition comes to have an atmospheric pressure. Incidentally, the atmosphere communication port 32 does not necessarily have to be provided in the front wall 40, and its placement is not limited so far as it allows the inside of the ink chamber 36 to communicate with the outside. Further, if the ink cartridge 30 is used while the inside of the ink chamber 36 is kept at the negative pressure, the atmosphere communication port 32 does not necessarily have to be provided.

As shown in FIG. 2, in the front wall 40 of the body 31, an ink supply section 37 is provided below the translucent portion 33. In the ink supply section 37, an ink channel 38 having a hole passing through part of the wall forming the ink channel 36 in the depth direction 53 is provided. The ink supply section 37 with a cylindrical outer shape projecting outward from the front wall 40 along the depth direction 53 is provided so as to surround the ink channel 38. The ink channel 38 extends along the depth direction 53 at a center portion of the ink supply section 37. The ink flows out from the ink chamber 36 through the ink channel 38 to an ink needle 122 provided in the cartridge installing section 110 (refer to FIG. 8).

As shown in FIG. 2, on an upper wall 39 of the body 31, a first engagement portion 43 is formed near a center thereof in the depth direction 53. The first engagement portion 43 has a flat surface spreading in the width direction 51 and the height direction 52 of the ink cartridge 30. A lock lever 145 engages with the first engagement portion 43 in the state where the ink cartridge 30 is installed in the cartridge installing section 110. The first engagement portion 43 receives a biasing force that pushes the ink cartridge 30 to the outside via the opening 112 (arrow 55 in FIG. 8). On the right and left of the first engagement portion 43 in terms of the width direction 51, a pair of ribs each having a flat surface extending along the depth direction 53 is disposed. When the ink cartridge 30 is installed or removed to/from the cartridge installing section 110, the pair of ribs functions as a guided portion 49 guided along a guide groove 115 of the cartridge installing section 110.

As shown in FIG. 2, a first projection 45 and a second projection 46 are provided on the body 31. The first projection 45 is provided at an upper end of the front wall 40 of the body 31. A width of the first projection 45 is equal to a width of the front wall 40. The first projection 45 extends from the front wall 40 along the depth direction 53 to a side opposite the rear wall 42. The first projection 45 is equal in width to the front wall 40, but may have a plate shape narrower in width than the front wall 40. In the first projection 45, a groove 47 extending in the depth direction 53 is formed at a center thereof in the width direction 51. In the groove 47, a rib 48 extending in the height direction 52 and the depth direction 53 is provided at a center thereof in the width direction 51.

The second projection 46 is provided at a lower end of the front wall 40 of the body 31. Therefore, the second projection 46 is disposed below the ink supply section 37. A width of the second projection 46 is equal to the width of the front wall 40. The second projection 46 extends from the front wall 40 along the depth direction 53 to the side opposite the rear wall 42. A tip of the second projection 46 extends up to a position more distant from the ink chamber 36 than a tip of the ink supply section 37 does.

In this embodiment, the dimensions in the width direction 51 of the first projection 45 and the second projection 46 may be equal, but the dimensions in the width direction 51 of the first projection 45 and the second projection 46 may be appropriately changeable, and for example, they may be projections in a plate shape extending along the depth direction 53 like the rib 48.

As shown in FIG. 2, on a lower wall 41 of the body 31, a guided portion 44 extending all along the depth direction 53 is provided. The guided portion 44 is a rib or a projecting piece projecting downward from the lower wall 41. When the ink cartridge 30 is installed into and removed from the cartridge installing section 110, the guided portion 44 is inserted to a guide groove 115 to be moved (to be described later).

As shown in FIG. 2, on the upper wall 39 of the body 31, the guided portion 49 extending all along the depth direction 53 is provided. The guided portion 49 is a rib or a projecting piece projecting upward from the upper wall 39. When the ink cartridge 30 is installed/removed to/from the cartridge installing section 110, the guided portion 49 is inserted to the guide groove 115 to be moved (to be described later).

<Ink Supply Device 100>

As shown in FIG. 1, the ink supply device 100 is provided in the printer 10. The ink supply device 100 supplies the ink from the ink cartridges 30 to the recording head 21. The ink supply device 100 includes the cartridge installing section 110 in which the ink cartridges 30 are installable. Note that FIG. 1 shows the state where the ink cartridge 30 is installed in the ink cartridge installing section 110.

<Cartridge Installing Section 110>

Figure 3:
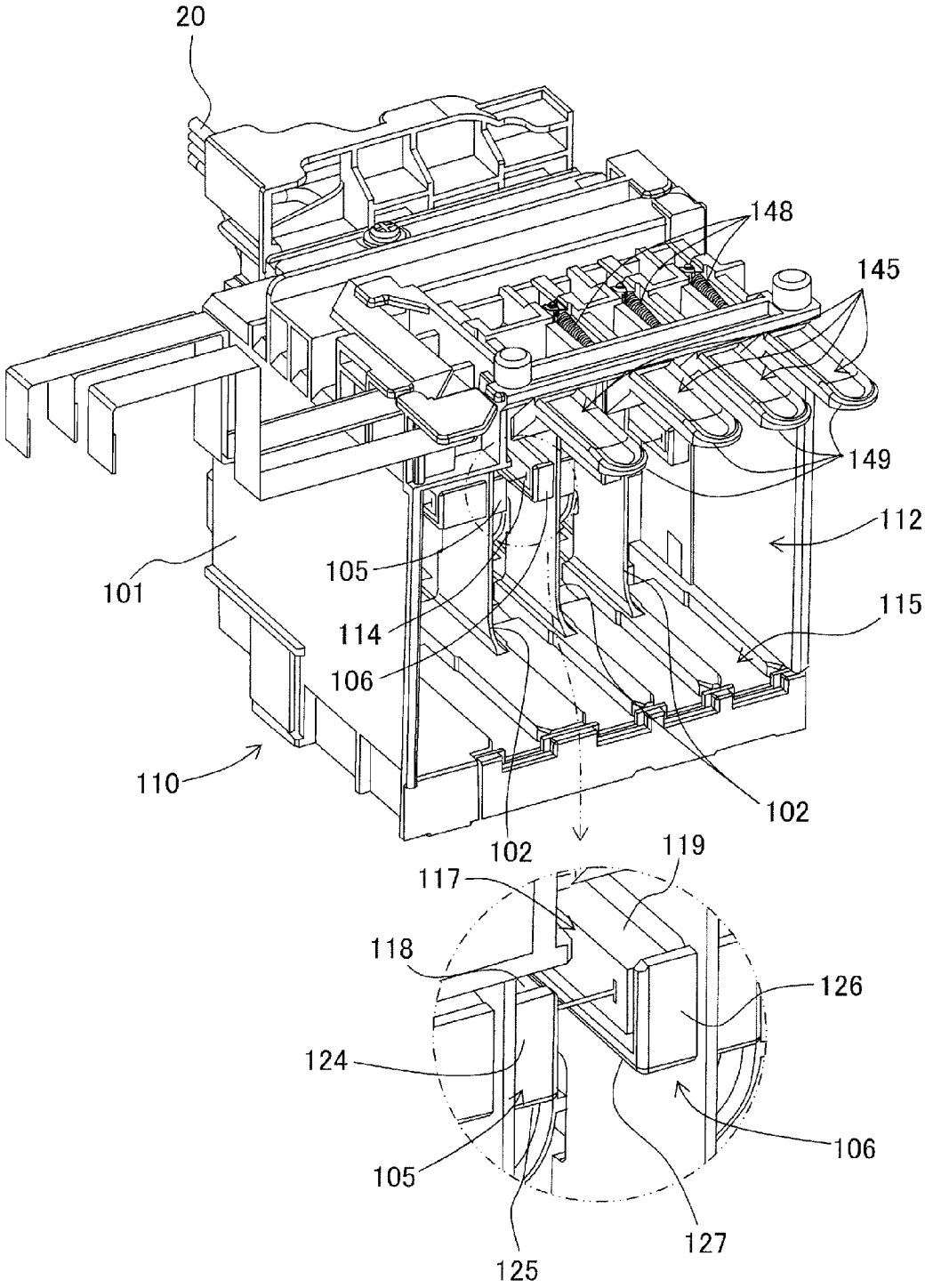
FIG. 3 is a perspective view illustrating an external configuration of a cartridge installing section 110 on its opening 112 side.

As shown in FIG. 3, a case 101 forming a casing of the cartridge installing section 110 has the opening 112 on the front surface side of the printer 10. The ink cartridge 30 is installed into and removed from the case 101 through the opening 112. Owing to the insertion of the guided portion 44 to the guide groove 115 provided on a bottom surface demarcating a bottom portion of an inner space of the case 101, the ink cartridge 30 is guided in the installing direction 56 (removal direction 55). In the case 101, four ink cartridges 30 for cyan, magenta, yellow, and black colors respectively are mountable. Incidentally, in the drawings, the guide grooves 115 appear only on the bottom surface side of the inner space of the case 101, but the similar guide grooves 115 are also formed on a ceiling side of the inner space.

As shown in FIG. 3, in the case 101, there are provided three plates 102 partitioning the inner space into four spaces corresponding to the respective ink colors, which are elongated in the vertical direction (up-down direction). The ink cartridges 30 are housed in the respective spaces separated by the plates 102. The plates 102 are provided in the case 101 on an opposite side of the opening 112 (an end side).

Figure 5:
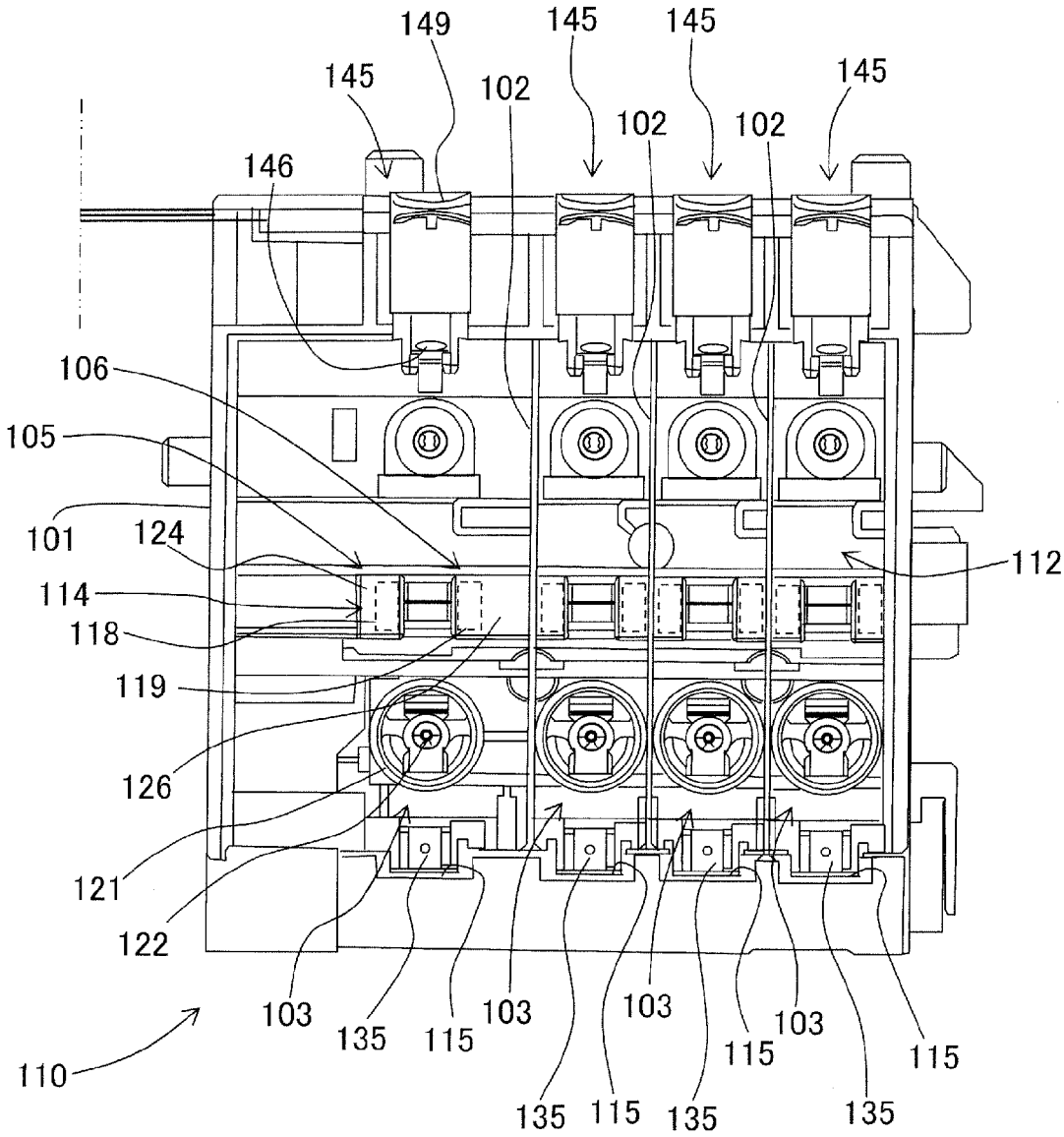
FIG. 5 is a front view of the cartridge installing section 110.

As shown in FIG. 5, connecting sections 103 are provided on a lower portion of an end surface of the case 101. On the up-down direction lower portion of the end surface, the connecting sections 103 are disposed for the respective ink colors, at positions corresponding to the ink supply sections 37 of the respective ink cartridges 30 installed in the case 101. In this embodiment, the four connecting sections 103 are provided so as to correspond to the respective four ink cartridges 30 mountable to the case 101.

Figure 6:
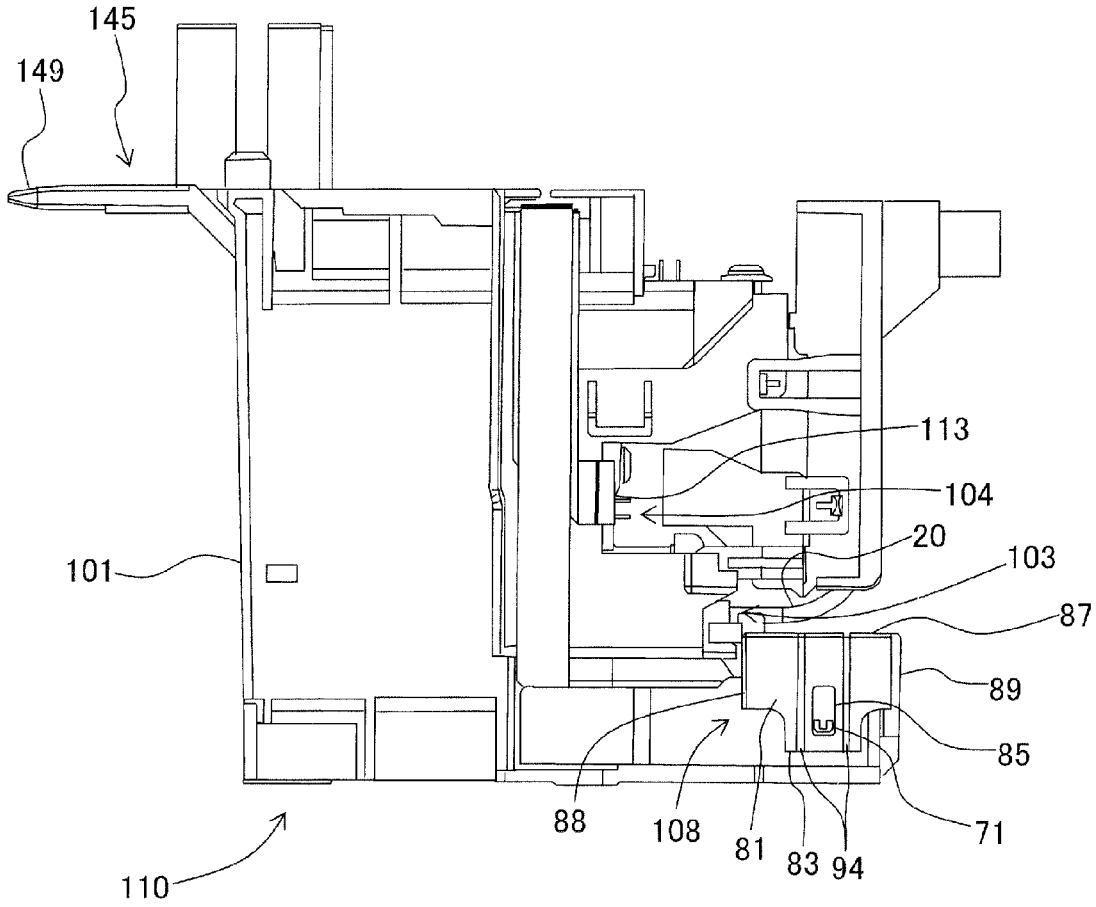
FIG. 6 is a side view of the cartridge installing section 110.

The connecting sections 103 each have the ink needle 122 and a holding portion 121. The ink needles 122 are each made of a tubular resin needle. The ink needles 122 are connected to the ink tubes 20 on an outer surface side of the case 101 opposite the opening 112 (on the rear side of the end surface of the case 101) as shown in FIG. 6. The ink tubes 20 drawn out from the respective ink needles 122 to the opposite side of the opening 112 are drawn upward and thereafter extend so as allow the inks to flow therethrough to the recording head 21 of the printer 10.

The holding portions 121 are formed as cylindrical recessed portions. The ink needles 122 are disposed at center portions of the holding portions 121. As shown in FIG. 8, when the ink cartridges 30 are installed in the cartridge installing section 110, the ink supply sections 37 are inserted to the holding portions 121. At this time, the ink needles 122 are inserted to the ink channels 38 of the ink supply sections 37, with outer peripheral surfaces of the ink supply sections 37 and inner surfaces of the holding portions 121 being in close contact with each other, or with a gap being left between the outer peripheral surfaces of the ink supply sections 37 and the inner surfaces of the holding portions 121. Consequently, the inks stored in the ink chambers 36 can flow out. The inks flowing out from the ink chambers 36 flow into the ink needles 122.

As shown in FIG. 5, on the end surface of the case 101, a sensor unit 104 is provided on upper side of the connecting sections 103 in a gravity-direction (vertical-direction). The sensor unit 104 includes a substrate 113 and the optical sensors 114. In the sensor unit 104, the optical sensors 114 are installed and fixed on the substrate 113. The four optical sensors 114 are attached to the substrate 113 of the sensor unit 104. These four optical sensors 114 are provided to correspond to the respective four ink cartridges 30 mountable to the case 101. The four optical sensors 114 are each disposed between the plates 102 and are arranged in line in a width direction of the case 101. Note that the width direction of the case 101 matches the width direction 51 of the ink cartridge 30.

The optical sensors 114 each have a light-emitting element 118, e.g., an LED and a light-receiving element 119, e.g., a phototransistor. The light-emitting elements 118 and the light-receiving elements 119 are each surrounded by a resin frame. Such light-emitting elements 118 and light-receiving elements 119 are disposed to face each other at a predetermined space. Part of the frame of each of the light-emitting elements 118 is cut out and the infrared light is output in one direction from the cutout. Part of the frame of each of the light-receiving elements 119 is a cut out and the infrared light entering the cutout can be received. The translucent portions 33 of the ink cartridges 30 each can enter a space between the light-emitting element 118 and the light-receiving element 119. The optical sensors 114 each correspond to a second sensor of the present teaching.

When the light is emitted from the light-emitting element 118 in the state where the ink cartridge 30 is installed in the case 101, the light pass through the translucent portion 33. In a state where the ink chamber 36 is filled with the ink in an amount equal to or more than a predetermined amount, the indicator portion 62 of the sensor arm 60 block the light radiated to the translucent portion 33. However, when the amount of the ink in the ink chamber 36 becomes less than the predetermined amount, the sensor arm 60 pivots, so that the indicator portion 62 of the sensor arm 60 does not block the light radiated to the translucent portion 33. That is, the posture of the sensor arm 60 changes based on the amount of the ink stored in the ink chamber 36. The infrared light output from the light-emitting element 118 is shut off by the translucent portion 33 or penetrates through the translucent portion 33 according to the change in the posture of the sensor arm 60. An amount of the light received by the light-receiving element 119 changes depending on whether the light emitted from the light-emitting element is blocked by the indicator portion 62 or not. Depending on this change, the light-receiving element 119 outputs different electric signals. According to the difference in the electrical signals output from the optical sensor 114, it can be determined whether or not an amount of the ink in the ink chamber 36 is less than the predetermined amount.

As shown in FIG. 3, covers 105, 106 covering the light-emitting elements 118 and the light-receiving elements 119 of the optical sensors 114 are provided in the case 101. Four pairs of the covers 105, 106 are provided to correspond to the respective four optical sensors 114. The covers 105 cover the light-emitting elements 118, respectively. The covers 106 cover the light-receiving elements 119, respectively. The covers 105, 106 each correspond to a second block member of the present teaching.

The covers 105 are each formed to project from the plate 102 in the horizontal direction and each have a first wall 124 extending in the horizontal direction and a second wall 125 extending in the vertical direction. The second wall 125 extends upward in the vertical direction from an end of the first wall 124 at the opening 112 side. That is, the first wall 124 and the second wall 125 are connected to each other to be perpendicular to each other. The first wall 124 covers a lower side of the light-emitting element 118 in the vertical direction. The second wall 125 covers an opening side of the light-emitting element 118, that is, a side to which the ink cartridge 30 is installed (installing direction 56 side).

The covers 106 are each formed to project from the plate 102 in the horizontal direction and each have a first wall 126 extending in the horizontal direction and a second wall 127 extending in the vertical direction. The second wall 127 extends upward in the vertical direction from an end of the first wall 126 at the opening 112 side. That is, the first wall 126 and the second wall 127 are connected to each other so as to be perpendicular to each other. The first wall 126 covers a lower side of the light-receiving element 119 in the vertical direction. The second wall 127 covers an opening side of the light-receiving element 119, that is, a side to which the ink cartridge 30 is installed (installing direction 56 side).

As shown in FIG. 8, optical sensors 116 are provided on an opening end portion of a top surface of the case 101. The optical sensors 116 detect the ribs 48 of the first projections 45 of the ink cartridges 30. In this embodiment, the four optical sensors 116 are provided to correspond to the respective four ink cartridges 30 mountable to the case 101. When each of the ink cartridges 30 is installed in the case 101, the rib 48 of the first projection 45 enters an optical path of the optical sensor 116. By detecting a change in a signal of the optical sensor 116 at this time, it is possible to determine an installation state of the ink cartridge 30. The optical sensors 116 each have a light-emitting element and a light-receiving element similarly to the optical sensors 114, but a detailed explanation of the structure of the optical sensors 116 will be omitted here.

As shown in FIG. 8, slide members 135 are disposed in a space 130 formed on a lower end side of the end surface of the cartridge installing section 110. In this embodiment, the four slide members 135 are provided to correspond to the respective four ink cartridges 30 mountable to the case 101. The space 130 communicates with the inner space of the cartridge installing section 110. The slide members 135 are supported to be capable of sliding along the installing direction 56 or the removal direction 55 by being guided by support rods 133 extending along the installing direction 56 or the removal direction 55 in the space 130. The slide members 135 each have an outer shape of a substantially rectangular parallelepiped. On upper ends of the slide members 135, ribs 136 extending along the insertion and removal direction 50 are provided, though not shown in detail in the drawings. The slide members 135 are disposed in routes where the second projections 46 of the ink cartridges 30 are inserted and are capable of abutting on the second projections 46. The slide members 135 each correspond to a detection target of the present teaching.

Coil springs 139 are provided in the space 130. The coil springs 139 bias the slide members 135 toward the opening 112. That is, the coil springs 139 resiliently bias the ink cartridges 30 in a direction in which the ink cartridges 30 are pulled out or removed from the cartridge installing section 110. The coil springs 139 are inserted through the support rods 133 extending along the installing direction 56 (removal direction 55) in the space 130 and are interposed between an end wall 131 demarcating an end of the space 130 and the slide members 135. When each of the coil springs 139 has a natural length, that is, while no external force is applied to the slide member 135, the slide member 135 is disposed at a predetermined position on the opening 112 side. In the course when the ink cartridge 30 is inserted to the cartridge installing section 110, the second projection 46 of the ink cartridge 30 abuts on the slide member 135, so that the slide member 135 is pressed toward the end wall 131 of the space 130. Consequently, the coil spring 139 is contracted and the slide member 135 is slid to a position on the end wall 131 side (refer to FIG. 8). The contracted coil spring 139 biases the ink cartridge 30 via the slide member 135 in the direction in which the ink cartridge 30 is removed from the case 101 (removal direction 55). The coil springs 139 each correspond to a biasing member in the present teaching. The removal direction 55 corresponds to a first direction.

As shown in FIG. 8, on the end surface of the case 101, a sensor unit 107 is provided at a position positioned under the connecting sections 103 in a vertical direction and is on an upper side of the slide members 135 in the vertical direction. The sensor unit 107 includes a substrate 111 and optical sensors 117. The sensor unit 107 is structured so that the optical sensors 117 are mounted on the substrate 111. In the sensor unit 107, the four optical sensors 117 are provided. These four optical sensors 117 are provided to correspond to the respective four ink cartridges 30 mountable to the case 101. In other words, the four optical sensors 117 are provided to correspond to the respective four slide members 135. The four optical sensors 117 are arranged in the width direction of the case 101 on the upper side of the space 130. Note that the width direction of the case 101 matches the width direction 51 of the ink cartridge 30. The optical sensors 117 each correspond to a first sensor of the present teaching.

When each of the ink cartridges 30 is installed in the case 101, the slide member 135 is moved toward the end wall 131 of the space 130, so that the rib 136 enters an optical path of the optical sensor 117. By detecting a change in a signal of the optical sensor 117 at this time, it is possible to determine the installed state of the ink cartridge 30. The optical sensors 117, similarly to the optical sensors 114, each have a light-emitting element and a light-receiving element. Here, a detailed explanation of the structure of the optical sensors 117 will be omitted here.

Figure 7:
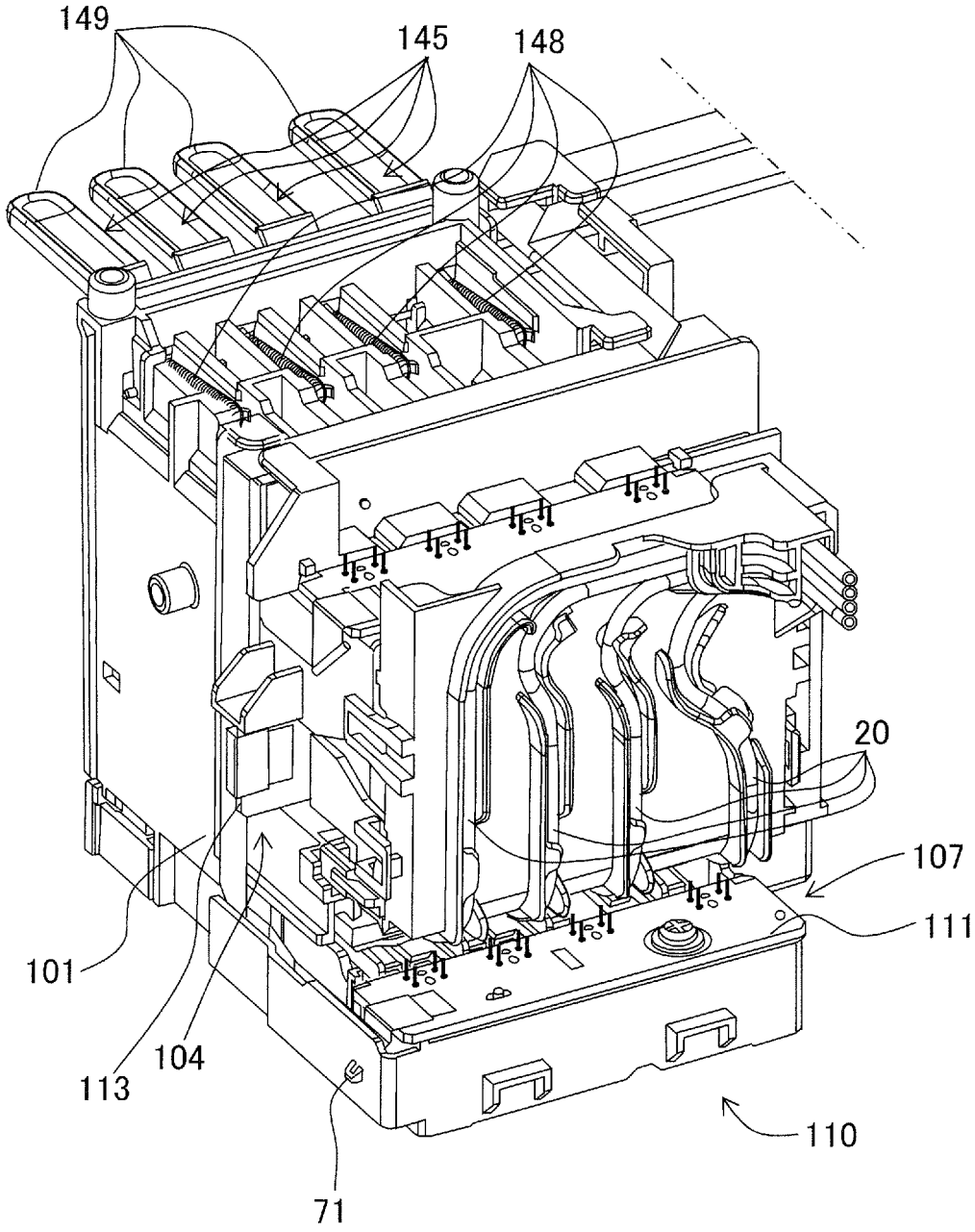
FIG. 7 is a perspective view illustrating the external configuration of the cartridge installing section 110 on its side opposite the opening 112, in a state where a cover 108 is removed.

As shown in FIG. 7, on the rear side of the end surface of the case 101 (outer surface side of the case 101), the substrate 111 of the sensor unit 107 is supported by the case 101, in a state where it is disposed to extend along the horizontal direction. From the substrate 111 supported by the case 101, the sensors 117 project downward in the vertical direction to enter the space 130. In an upper surface of the substrate 111 supported by the case 101, the contact portions with the sensors 117 and the like are exposed. The contact portions and the like electrically connect circuit patterns of the substrate 111 and the sensors 117.

Figure 4:
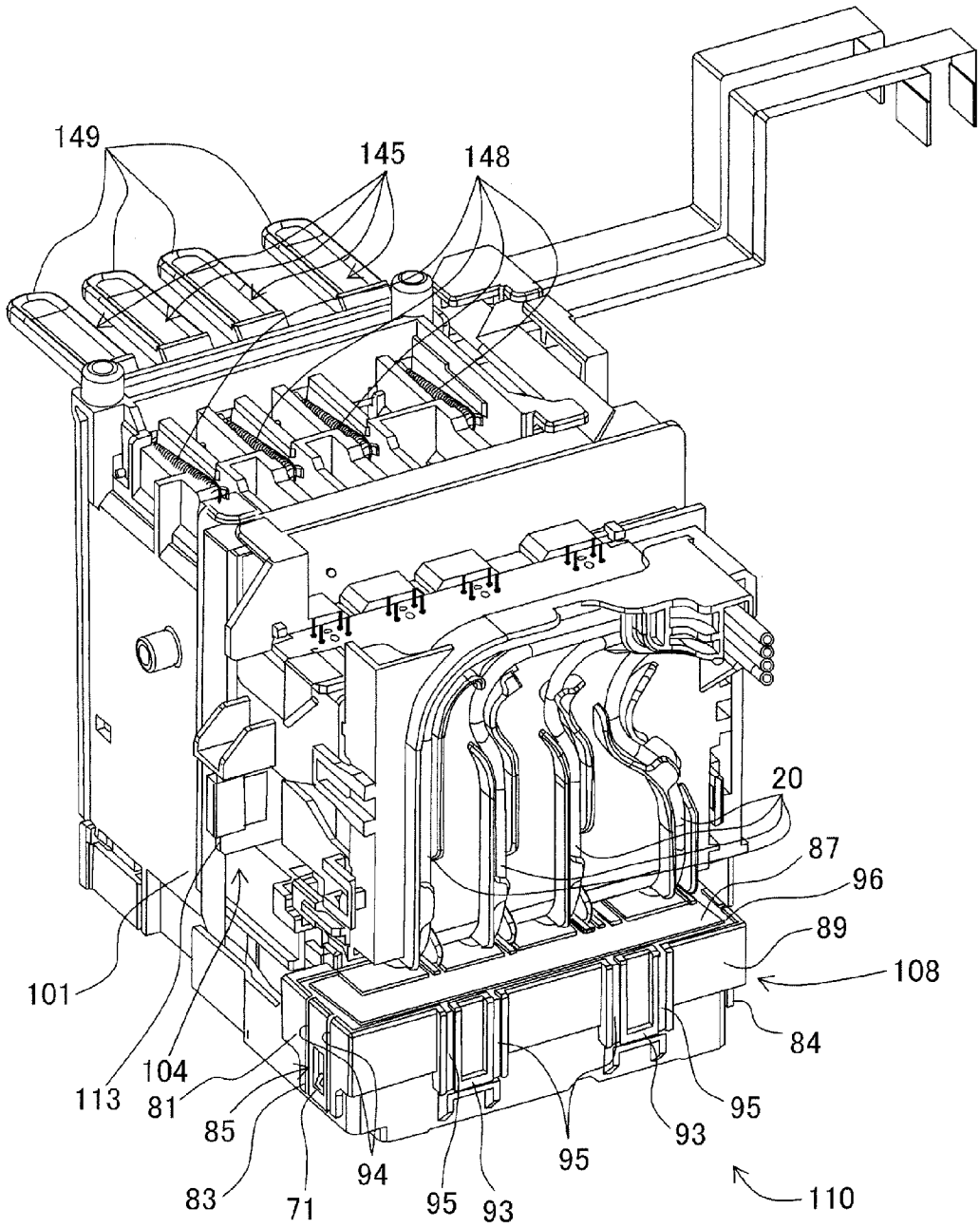
FIG. 4 is a perspective view illustrating an external configuration of the cartridge installing section 110 on its side opposite the opening 112.

As shown in FIG. 4, the upper surface of the substrate 111 of the sensor unit 107 is covered by a cover 108. The cover 108 is disposed on the lower side of the ink needles 122 and the ink tubes 20 in a vertical direction. The cover 108 is kept covering the upper surface of the substrate 111 by being assembled to the case 101.

As shown in FIG. 8, the lock levers 145 are provided on the case 101. The ink cartridges 30 installed in the cartridge installing section 110 are kept in the installed state against the biasing forces of the coil springs 139 by the lock levers 145. The lock levers 145 are provided on an upper side of the opening 112 of the case 101. In this embodiment, the four lock levers 145 are provided to correspond to the respective four ink cartridges 30 installable in the case 101.

The whole lock levers 145 are formed in an arm shape. Support shafts 147 are provided near centers of the lock levers 145. The support shafts 147 are supported by the case 101. Consequently, on the upper side of the opening 112 of the case 101, the lock levers 145 are supported to be pivotable with respect to the support shafts 147. The lock levers 145 each include an operation portion 149 and a second engagement portion 146. The operation portions 149 are formed to project outward from the opening 112 of the case 101. The operation portions 149 are portions receiving an operation for causing the lock levers 145 to pivot. The second engagement portions 146 are inside the case 101. The second engagement portions 146 are capable of engaging with the first engagement portions 43 of the ink cartridges 30. By the engagement of the second engagement portions 146 and the first engagement portions 43, the ink cartridges 30 biased by the coil springs 139 are kept in the installed state in the case 101. A pivot position of the lock lever 145 when the second engagement portion 146 and the first engagement portion 43 are engageable with each other (refer to FIG. 8) is called a lock position (first posture), and a position of the lock lever 145 when the second engagement portion 146 and the first engagement portion 43 are not engaged with each other is called an unlock position (second posture). The lock levers 145 each correspond to a lock member in the present teaching.

Coil spring 148 are attached to the lock levers 145. The coil springs 148 bias the lock levers 145 toward the lock position. When the operation portion 149 is pushed down in the vertical direction while the lock lever 145 is at the lock position, the lock lever 145 pivots from the lock position to the unlock position. The lock levers 145 each correspond to a lock member of the present teaching.

<Cover 108>

Figure 10:
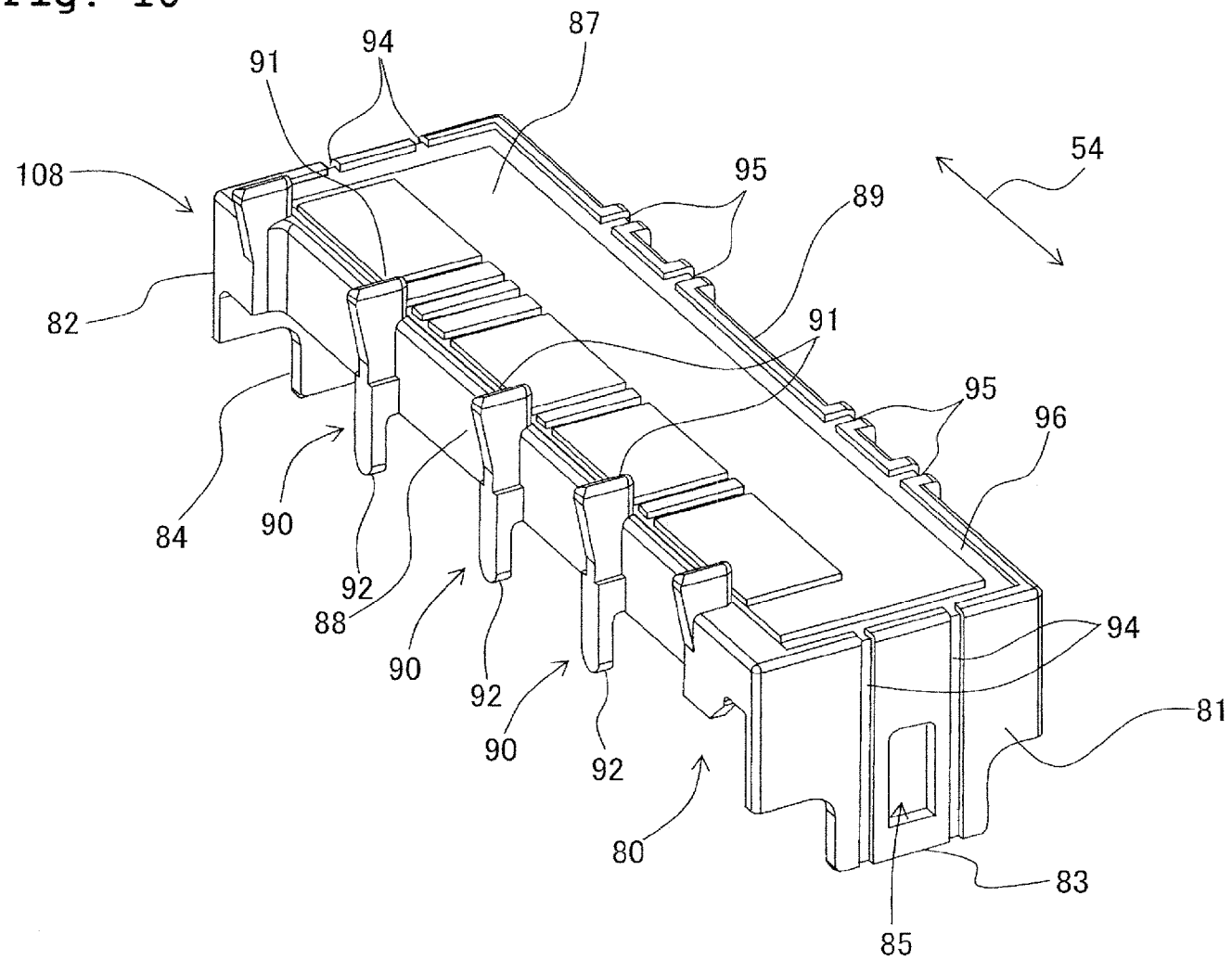
FIG. 10 is a perspective view of the cover 108.
Figure 11:
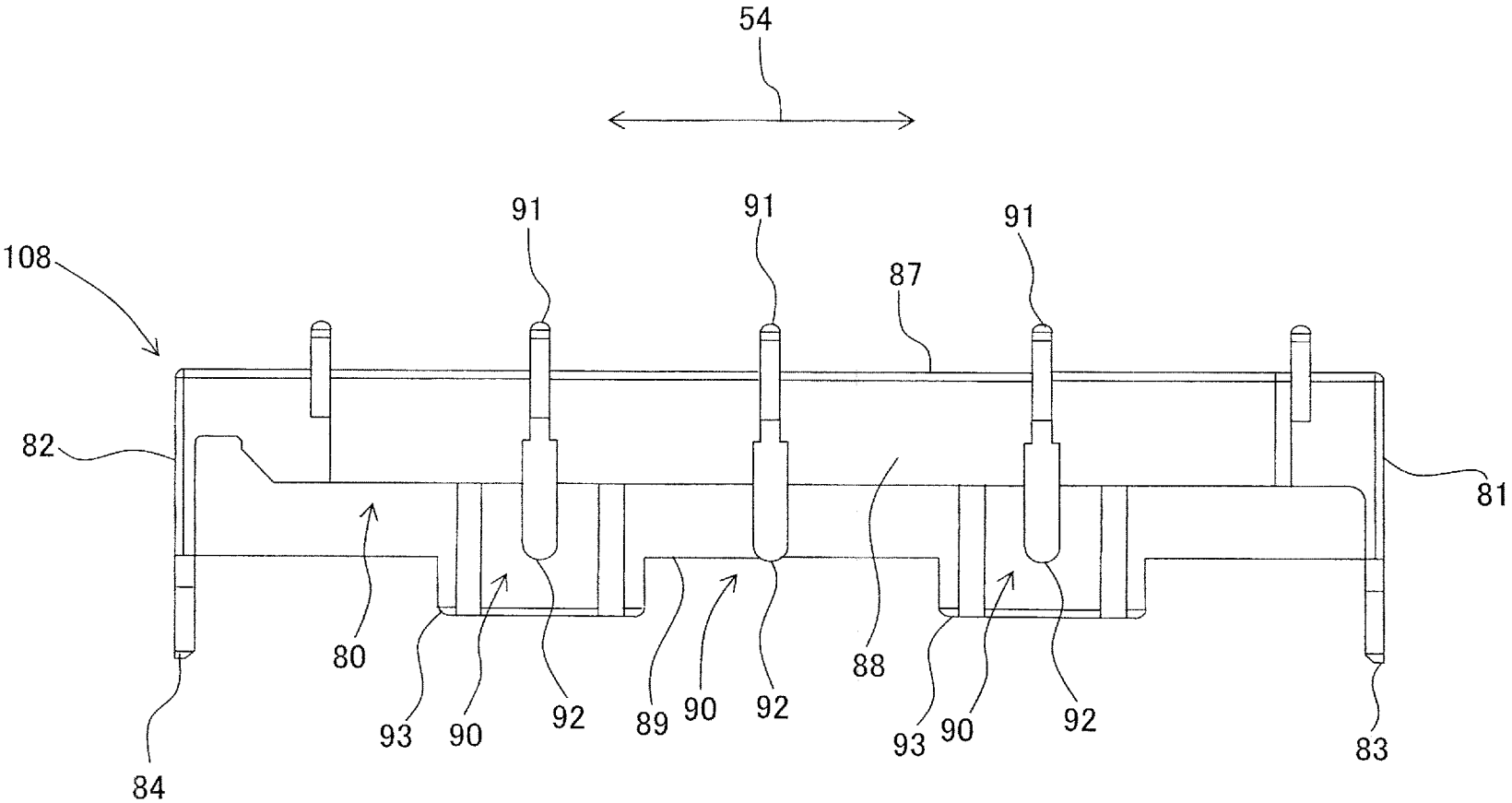
FIG. 11 is a front view of the cover 108 seen from a sidewall 88 side.
Figure 12:
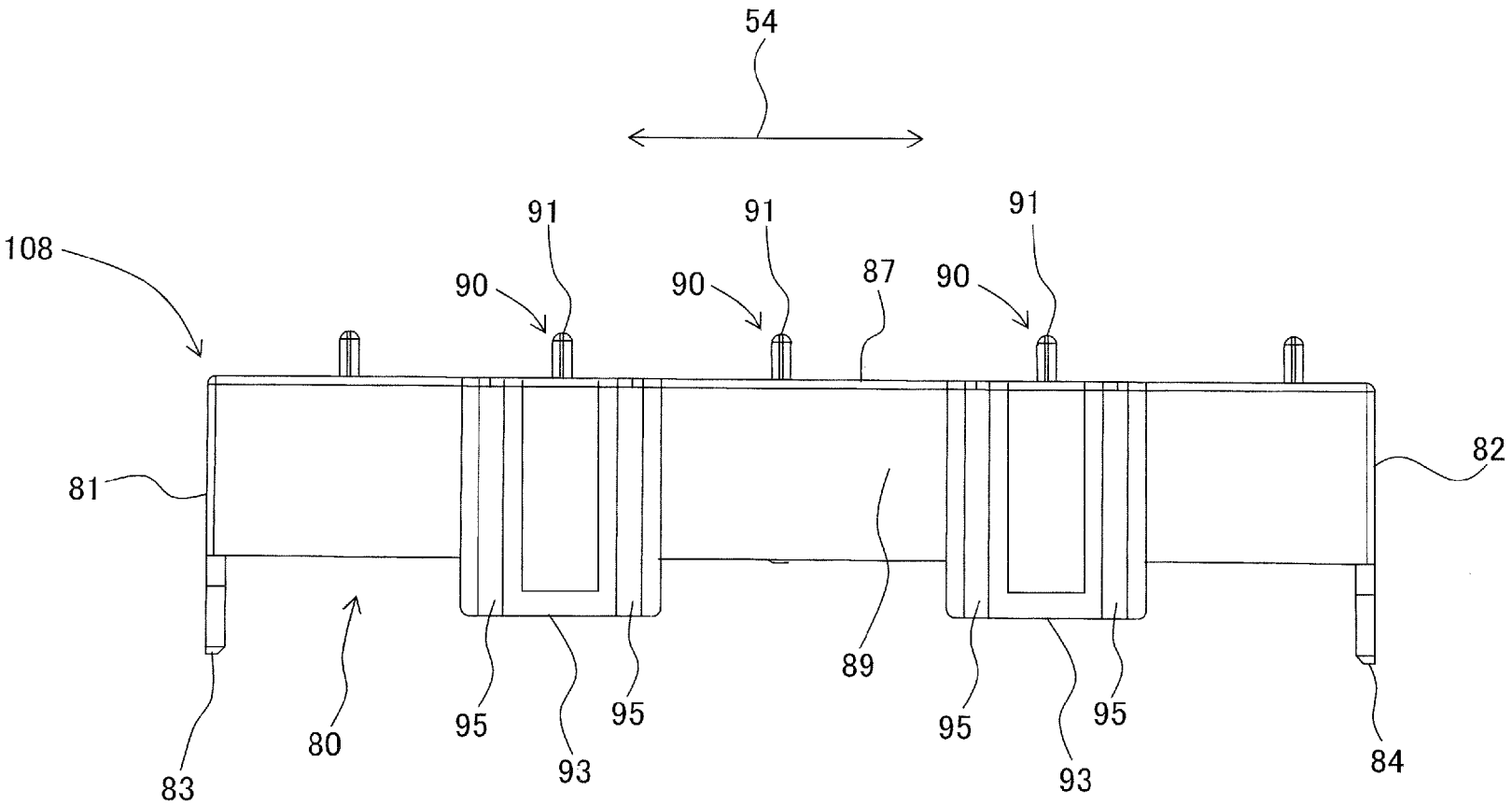
FIG. 12 is a rear view of the cover 108 seen from a sidewall 89 side.

As shown in FIG. 8, the cover 108 may cover the upper surface of the substrate 111 of the sensor unit 107. As shown in FIGS. 10 to 12, the cover 108 is a rectangular parallelepiped box that is elongated in the direction in which the four optical sensors 117 are arranged, and in its bottom surface side, an opening 80 is formed. The opening 80 is slightly larger than the outer shape of the substrate 111. Therefore, the substrate 111 is capable of inserting the inside of the cover 108 through the opening 80. The engagement pieces 83, 84 are formed to extend downward from lower ends thereof on sidewalls 81, 82 which correspond to both ends of the cover 108 in terms of a longitudinal direction 54. Through holes 85, 86 are formed in areas spreading from the engagement pieces 83, 84 to the sidewalls 81, 82. The engagement pieces 83, 84 and the engagement claws 71, 72 are engaged with each other by the insertion of engagement claws 71, 72 provided in the case 101 to the through holes 85, 86, so that the cover 108 is assembled to the case 101. The cover 108 corresponds to a first partitioning member of the present teaching.

An upper wall 87 and sidewalls 88, 89 are provided to be connected to the sidewalls 81, 82. In other words, the sidewalls 81, 82, 88, 89 are provided to extend from the upper wall 87 in the upward and downward in the height or vertical direction. In the state where the cover 108 is assembled to the case 101, the upper wall 87 is arranged to be parallel to the substrate 111 of the sensor unit 107. In the state where the cover 108 is assembled to the case 101, the sidewalls 88, 89 together with the sidewalls 81, 82 surround the substrate 111 of the sensor unit 107. These sidewalls 81. 82, 88, 89 and upper wall 87 cover the upper surface side of the substrate 111 of the sensor unit 107.

In the state where the cover 108 is assembled to the case 101, the sidewall 88 faces the connecting sections 121. A plurality of ribs (convex strips) 90 extending in the vertical direction are provided on the sidewall 88. The ribs 90 are formed to project from the sidewall 88 outward in the horizontal direction toward the rear side of the end surface of the case 101. Further, the upper ends 91 of the ribs 90 in the vertical direction are formed to project to a position higher than an upper end of the sidewall 88. The lower ends 92 of the ribs 90 in the vertical direction are formed to project to a position lower than a lower end of the sidewall 88. Therefore, in the state where the cover 108 is assembled to the case 101, the ribs 90 extend from the upper side to the lower side of the substrate 111 of the sensor unit 107 in the vertical direction.

The ribs 90 are intended to guide the ink dropping to the ribs 90, downward in the vertical direction. The ink dropping near the upper ends 91 of the ribs 90 flow down from the upper ends 91 to the lower ends 92 along the ribs 90 due to the gravity. The ink reaching the lower ends 92 drops downward in the vertical direction from the lower ends 92 due to the gravity. Since the lower ends 92 extend to the position lower than the lower end of the sidewall 88, the ink dropping to the ribs 90 is prevented from flowing along the lower end of the sidewall 88 to flow to the substrate 111 side of the sensor unit 107. The ribs 90 each correspond to a rib of the present teaching.

In a peripheral edge of the upper wall 87, that is, near the sidewalls 81, 82, 88, 89, a groove 96 which is lower than the other portion, that is, than a center portion, is formed. The groove 96 is formed in a quadrangular loop to surround the peripheral edge of the upper wall 87.

Upper ends of the sidewalls 81, 82, 89 are formed to project slightly above the upper wall 87. Two grooves 94 extending from an upper end of each of the sidewalls 81, 82 to a lower end of each of the engagement pieces 83, 84 are formed. The grooves 94 are formed to be indented in a thickness direction of the sidewalls 81, 82. Owing to the grooves 94, parts of the upper ends of the sidewalls 81, 82 have the same height as that of a bottom of the groove 96 of the upper wall 87. On a lower end of the sidewall 89, two projecting pieces 93 projecting downward in the vertical direction are provided. In the sidewall 89, four grooves 95 extending from an upper end thereof to lower ends of the projecting pieces 93 and indented in a thickness direction of the sidewall 89 are formed. Owing to the grooves 95, parts of the upper end of the sidewall 89 have the same height as that of the bottom of the groove 96 of the upper wall 87.

The grooves 94, 95 guide the ink dropping to and pooling on the upper wall 87, downward in the vertical direction. The ink dropping to the upper wall 87 is guided toward the sidewalls 81, 82, 89 along the groove 96, and when the ink reaches the grooves 94, 95 at the upper ends of the sidewalls 81, 82, 89, the ink flows down along the grooves 94, 95 due to the gravity. The ink reaching lower ends of the grooves 94, 95 drops downward in the gravity direction from the lower ends due to the gravity. The engagement pieces 83, 84 and the projecting pieces 93 being the lower ends of the grooves 94, 95 are formed to extend to the position lower than the lower ends of the sidewalls 81, 82, 89, and therefore, the ink dropping to the upper wall 87 is prevented from flowing along the lower ends of the sidewalls 81, 82, 89 to flow toward the substrate 111 of the sensor unit 107.

According to this embodiment, the upper side of the substrate 111 of the sensor unit 107 disposed on the lower side of the connecting sections 121 and the ink tubes 20 in the vertical direction is covered by the cover 108. Therefore, even if the ink leaks from the connecting sections 121 or the ink tubes 20, the ink does not adhere to the substrate 111. Therefore, the sensor unit 107, that is, the optical sensors 117 and the substrate 111 can be disposed near the connecting sections 121 and the ink tubes 20. This ensures the detection of the slide members 135 by the optical sensors 117 and the connection of the ink cartridges 30 and the connecting sections 121, even if the ink cartridges 30 have play in relation to the cartridge installing section 110.

Further, since the cover 108 has the ribs 90 extending from a upper side to a lower side of the substrate 111 of the sensor unit 107 in the vertical direction, the ink dropping to the ribs 90 flows down along the ribs 90 due to the gravity to reach the lower side of the substrate 111 in the vertical direction. This prevents the ink from flowing from the lower end of the sidewall 88 of the cover 108 toward the substrate 111.

Further, since the groove 96 is formed in the upper wall 87 of the cover 108 and the grooves 94, 95 are formed in the sidewalls 81, 82, 89, the ink dropping to the upper wall 87 of the cover 108 flows down along the grooves 94, 95, 96 to the lower ends of the sidewalls 81, 82, 89 due to the gravity or a capillary force. This prevents the ink from flowing from the lower ends of the sidewalls 81, 82, 89 of the cover 108 toward the substrate 111.

Further, the slide members 135 each changing its posture according to the installation and the removal of the ink cartridge 30 are disposed near the connecting sections 121. The optical sensors 117 disposed near the connecting sections 121 each are capable of detecting the installation and the removal of the ink cartridge 30 by sensing the slide member 135. Therefore, it is possible to determine that the ink cartridge 30 is in the installed state when the ink supply section 37 of the ink cartridge 30 and the connecting section 121 are completely connected.

Further, since the ink cartridges 30 in the installed state are biased by the coil springs 139, the ink cartridges 30 are likely to rotate or the like within a range of play in relation to the cartridge installing section 110. Nevertheless, as previously described, since the optical sensors 117 disposed near the connecting sections 121 each detect the installation and removal of the ink cartridge 30, it is possible to determine that the ink cartridge 30 is in the installed state when the ink supply section 37 of the ink cartridge 30 and the connecting section 121 are completely connected to each other.

Further, since the lock levers 145 are each engaged with the first engagement portion 43 provided on the upper surface of the ink cartridge 30 in the installed state, the ink cartridge 30 easily rotates with respect to the first engagement portion 43 within a range of play. Nevertheless, as described above, since the optical sensors 117 disposed near the connecting sections 121 are each capable of detecting the installation and removal of the ink cartridge 30, it is possible to determine that the ink cartridge 30 is in the installed state when the ink supply section 37 of the ink cartridge 30 and the connecting section 121 are completely connected to each other.

Further, the covers 105, 106 covering the lower side and the installing direction 56 side of the optical sensors 114 capable of detecting the translucent portions 33 of the ink cartridges 30 in the installed state are provided in the case 101. Therefore, even if the ink scatters from the connecting sections 121, the ink does not adhere to the optical sensors 114. Further, even if the ink cartridge 30 is inserted in the cartridge installing section 110 in a wrong posture or even if the ink cartridge 30 having a shape not conforming to the cartridge installing section 110 is inserted, the ink cartridge 30 is prevented from colliding directly with the optical sensor 114.

Modification Example

In this embodiment, the optical sensors 117 optically detect the slide members 135. However, it should be noted that a change in a detection target in the present teaching is not limited to the movement such as the sliding as is the case with the slide members 135 or pivoting. For example, an optical property of the slide members 135 may change or their electric or magnetic property may change, and the first sensor may be structured to be capable of detecting these changes.

Further, in this embodiment, the movement of the slide members 135 provided in the case 101 is detected by the optical sensors 117. However, the present teaching is not limited to such a structure. For example, the second projections 46 of the ink cartridges 30 may be detected by the optical sensors 117, without the slide members 135 being provided.

Further, in this embodiment, the optical sensors 117 are fixed directly to the substrate 111, but the optical sensors 117 may be connected to the substrate 111 via conductive wires or the like.

What is claimed is:

1. An ink-jet printer configured to jet droplets of an ink onto a medium to perform printing, comprising:

a recording head configured to jet the droplets of the ink onto the medium; an ink cartridge configured to store the ink; and an ink supply device configured to supply the ink stored in the ink cartridge to the recording head, comprising:

a cartridge installing section configured to install the ink cartridge in a horizontal direction; an ink supply section configured to be in fluid communication with an ink supply portion of the ink cartridge; a first sensor disposed in the ink cartridge installing section and positioned under the ink supply section in a vertical direction; a first partitioning member which is disposed between the ink supply section and the first sensor in the vertical direction, and is configured to partition the ink supply section and the first sensor in the vertical direction such that the first partitioning member prevents a flow of the ink from the ink supply section to the first sensor; and an ink channel connecting between a connecting section and the recording head; wherein the first sensor is located outside of the ink channel; wherein the connecting section of the ink supply section is connected to the ink channel at an upper side of the partition member; wherein the recording head is connected to the ink channel at an upper side of the partition member;

wherein the partition member and the first sensor are positioned, in the vertical direction, under a region in which the ink channel connecting between the connecting section and the recording head is drawn; and wherein the first sensor is positioned under the partitioning member in the vertical direction.

2. The ink-jet printer according to claim 1; wherein the first sensor includes:

a first signal-emitting element configured to emit the first signal and a first signal receiving-element configured to receive the first signal which are disposed under the ink supply portion in the vertical direction, and a substrate which is electrically connected to the first signal-emitting element and first signal-receiving element.

3. The ink-jet printer according to claim 1;

wherein the first partitioning member includes:

a top plate;

a plurality of vertical plates that runs up and down in vertical direction perpendicular to the top plate, each of the vertical plates extending from the top plate to a lower side in the vertical direction; and a guide member which is provided in one of the top plate and the vertical plates.

4. The ink-jet printer according to claim 3;

wherein the guide member draws the ink which is attached on the first partitioning member.

5. The ink-jet printer according to claim 3;

wherein the vertical plates project upwardly with respect to the top plate.

6. The ink-jet printer according to claim 3;

wherein the guide member is formed, on one of the top plate and the vertical plates, as a rib or a groove.

7. The ink-jet printer according to claim 6;

wherein the rib or groove is provided in the vertical plate of the first cover member to extend in the vertical direction.

8. The ink-jet printer according to claim 2; wherein the cartridge installing portion includes a detection target of which position changes depend on whether the ink cartridge is in installed state or during the installation of the ink cartridge, and wherein the first sensor is configured to detect the detection target.

9. The ink-jet printer according to claim 8;

wherein the cartridge installing section further includes:

a biasing member which biases the detection target in a first direction opposite to an insertion direction of the ink cartridge; and a retaining member which is configured to change a posture between a first posture in which the retaining member keeps the ink cartridge in the first state from moving in the first direction against a biasing force of the biasing member and a second posture in which the retaining member allows the ink cartridge to move in the first direction.

10. The ink-jet printer according to claim 9;

wherein the retaining member is configured to retain with an engagement portion provided on an upper surface of the ink cartridge in the first state.

11. The ink-jet printer according to claim 8;

wherein the cartridge installing section further includes:

a second sensor disposed above the connecting section in the vertical direction and is configured to detect a part of the ink cartridge in the installed state; and a second partitioning member disposed above the connecting section in the vertical direction and which covers at least a lower side of the second sensor.

12. The ink-jet printer according to claim 11;

wherein the second partitioning member covers a portion, of the second sensor, on the insertion direction side.

13. The ink-jet printer according to claim 11;

wherein a part of the ink cartridge varies light attenuation conditions in accordance with a level of the ink stored in the ink cartridge.

14. The ink-jet printer according to claim 12;

wherein the second sensor includes:

a second signal-emitting element configured to emit a second signal and a second signal receiving-element configured to receive the second signal.

15. The ink-jet printer according to claim 14;

wherein a part of the ink cartridge is positioned between the second signal-emitting element and the second signal-receiving element.

* * * * *